US007456563B2

(12) United States Patent
Lee et al.

(10) Patent No.: US 7,456,563 B2
(45) Date of Patent: Nov. 25, 2008

(54) ELECTRON EMISSION DISPLAY AND MANUFACTURING METHOD OF THE SAME

(75) Inventors: Soo-Joung Lee, Yongin-si (KR); Jung-Ho Kang, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/540,767

(22) Filed: Sep. 29, 2006

(65) Prior Publication Data

US 2007/0075624 A1 Apr. 5, 2007

(30) Foreign Application Priority Data

Sep. 30, 2005 (KR) ..... 10-2005-0091986

(51) Int. Cl.
*H01J 1/62* (2006.01)
*H01J 63/04* (2006.01)

(52) U.S. Cl. ..... 313/495; 313/496; 313/497

(58) Field of Classification Search ..... 313/495–497
See application file for complete search history.

(56) References Cited

U.S. PATENT DOCUMENTS

2005/0134169 A1* 6/2005 Hwang ..... 313/496
2005/0179360 A1* 8/2005 Okamoto et al. ..... 313/495

* cited by examiner

*Primary Examiner*—Nimeshkumar D. Patel
*Assistant Examiner*—Thomas A Hollweg
(74) *Attorney, Agent, or Firm*—Christie, Parker & Hale, LLP

(57) ABSTRACT

An electron emission display includes first and second substrates facing each other. First electrodes are arranged on the first substrate along a first direction. Second electrodes are arranged along a second direction such that the second electrodes cross the first electrodes. Sub-pixels are formed at crossed regions of the first and second electrodes, and electron emission regions are provided on the first electrodes within the sub-pixels. Phosphor layers are formed on a surface of the second substrate such that the phosphor layers are spaced apart from each other with a distance therebetween. A metallic reflection layer is formed on the second substrate to cover the phosphor layers. The metallic reflection layer has spaced portions covering at least two of the phosphor layers and spaced away from the phosphor layers with an open gap therebetween, and contact portions not spaced away from the second substrate with an open gap therebetween.

13 Claims, 9 Drawing Sheets

ELECTRON EMISSION DISPLAY AND MANUFACTURING METHOD OF THE SAME

CROSS-REFERENCE TO RELATED APPLICATION

The application claims priority to and the benefit of Korean Patent Application No. 10-2005-0091986, filed on Sep. 30, 2005, in the Korean Intellectual Property Office, the entire content of which is incorporated herein by reference.

BACKGROUND OF THE INVENTION

1. Field of the Invention

The present invention relates to an electron emission display and a method of manufacturing the electron emission display, and in particular, to an electron emission display that improves the shape of an anode electrode to reduce or prevent color mixing and to heighten an adhesion of the anode electrode to a black layer, and a method of manufacturing the electron emission display.

2. Description of Related Art

In general, an electron emission element can be classified, depending upon the kind of electron source, into a hot cathode type or a cold cathode type.

Among the cold cathode type of electron emission elements, there are a field emitter array (FEA) type, a surface conduction emission (SCE) type, a metal-insulator-metal (MIM) type, and a metal-insulator-semiconductor (MIS) type.

Arrays of electron emission elements are arranged on a first substrate to form an electron emission device. A light emission unit is formed on a second substrate with phosphor layers and an anode electrode, and is assembled with the first substrate to thereby form an electron emission display.

In the electron emission display, a plurality of driving electrodes functioning as scanning and data electrodes are provided on a first substrate together with electron emission regions, and a light emission unit is provided on a second substrate. The electron emission regions and the driving electrodes are operated to control the on/off of electron emission for respective pixels and also the amount of electrons emitted from the electron emission regions. The electrons emitted from the electron emission regions excite the phosphor layers to thereby emit light or display images.

With the above described electron emission display, a metallic layer based on a metallic material, such as aluminum (Al), may be used as the anode electrode. The metallic anode electrode covers the phosphor layers and black layers, and reflects the visible rays radiated from the phosphor layers to the first substrate back toward the second substrate, thereby heightening the screen luminance.

The phosphor layers are formed by depositing phosphor particles with a particle size of several micrometers (μm), and the anode electrode is formed to be thin with a thickness of several thousands angstroms (Å) in view of the electron transmittance degree. In this situation, when aluminum is directly deposited onto a surface of the phosphor layers, it does not uniformly cover the surface of the phosphor particles and may include areas having no aluminum (e.g., periodic cuts or holes). This makes it difficult to form the anode electrode with a high uniformity.

Accordingly, in order to make the anode electrode more uniformly thick, a surface flattening layer is formed on the phosphor and black layers of the second substrate, and aluminum is deposited onto the surface flattening layer, thereby forming the anode electrode. The surface flattening layer is removed through firing, and after the firing, the anode electrode is spaced away from the phosphor and black layers with a certain (or predetermined) gap. That is, the anode electrode is smoothly deposited onto the surface flattening layer and so the periodic cuts thereof are reduced, thereby also heightening the reflection efficiency.

As the surface flattening layer is formed on the entire surface of the phosphor and black layers, the anode electrode is spaced away even from the non-light emission areas (i.e., the black layers) with a certain (or predetermined) gap. Consequently, when spacers are mounted corresponding to parts of the black layers before the assemblage of the first and second substrates, the anode electrode may be damaged by the spacers.

Furthermore, as the conventional anode electrode covers all the phosphor layers on the second substrate, the visible rays emitted from the different-colored phosphor layers are reflected by (or against) the anode electrode, and mixed, thereby inducing color mixing.

SUMMARY OF THE INVENTION

It is an aspect of the present invention to provide an improved electron emission display that blocks or prevents an anode electrode from being damaged during the mounting of spacers and reduces color mixing, thereby heightening the display quality.

It is another aspect of the present invention to provide a method of manufacturing the improved electron emission display.

According to one embodiment of the present invention, an electron emission display includes: a first substrate; a second substrate facing the first substrate; a plurality of first electrodes arranged on the first substrate along a first direction; a first insulating layer formed on the first substrate such that the first insulating layer covers the first electrodes; a plurality of second electrodes arranged on the first insulating layer along a second direction such that the second electrodes cross the first electrodes, sub-pixels being formed at crossed regions of the first and second electrodes; a plurality of electron emission regions provided on the first electrodes within the sub-pixels; a plurality of phosphor layers formed on a surface of the second substrate corresponding to the sub-pixels such that the phosphor layers are spaced apart from each other with a distance therebetween; and a metallic reflection layer formed on the second substrate such that the metallic reflection layer covers the phosphor layers. Here, the metallic reflection layer includes a plurality of spaced portions covering at least two of the phosphor layers respectively placed corresponding to the sub-pixels, the plurality of spaced portions are spaced away from the phosphor layers with an open gap therebetween, and the metallic reflection layer includes a plurality of contact portions connecting the spaced portions and not spaced away from the second substrate with an open gap therebetween.

The spaced portions of the metallic reflection layer may cover two or more of the phosphor layers arranged along a long axis direction of the second substrate, or two or more of the phosphor layers arranged along short axis direction of the second substrate. Furthermore, the spaced portions of the metallic reflection layer may simultaneously cover two or more of the phosphor layers arranged along a long axis direction of the second substrate and two or more of the phosphor layers arranged along a short axis direction of the second substrate.

An area of each of the spaced portions of the metallic reflection layer may be established to be larger than a whole area of at least two of the phosphor layers placed within each of the spaced portions.

According to another embodiment of the present invention, in a method of manufacturing an electron emission display, black layers are formed on a substrate at non-light emission areas and phosphor layers are formed on the substrate at light emission areas. A surface flattening layer is formed on at least two neighboring phosphor layers and at least one of the black layers disposed between the neighboring phosphor layers. A metallic reflection layer is formed on an entire surface of the substrate and the substrate is fired to thereby remove the surface flattening layer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

The accompanying drawings, together with the specification, illustrate exemplary embodiments of the present invention, and, together with the description, serve to explain the principles of the present invention.

Figure 1:
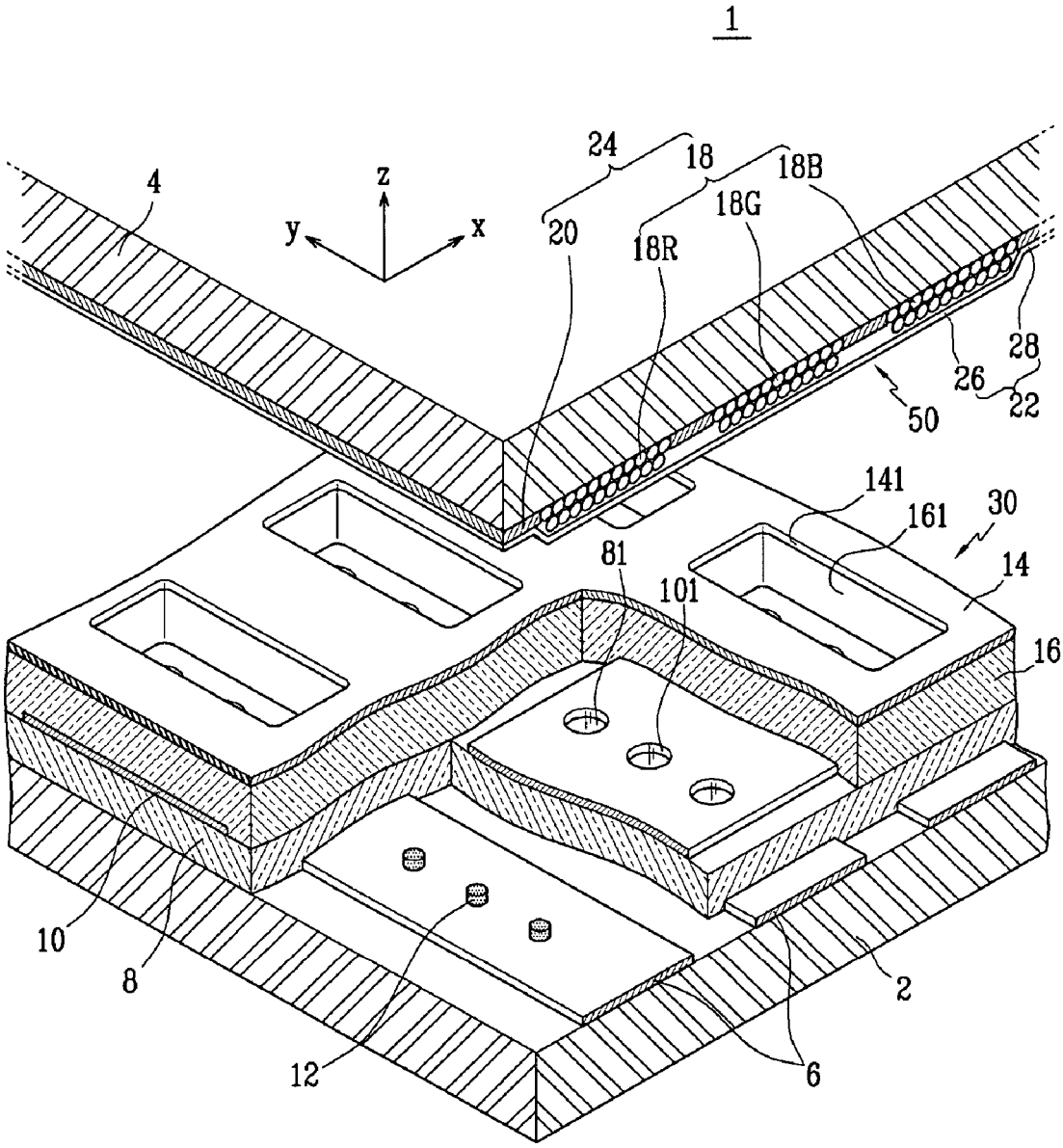
FIG. 1 is a partial exploded perspective view of an electron emission display according to a first embodiment of the present invention.
Figure 2:
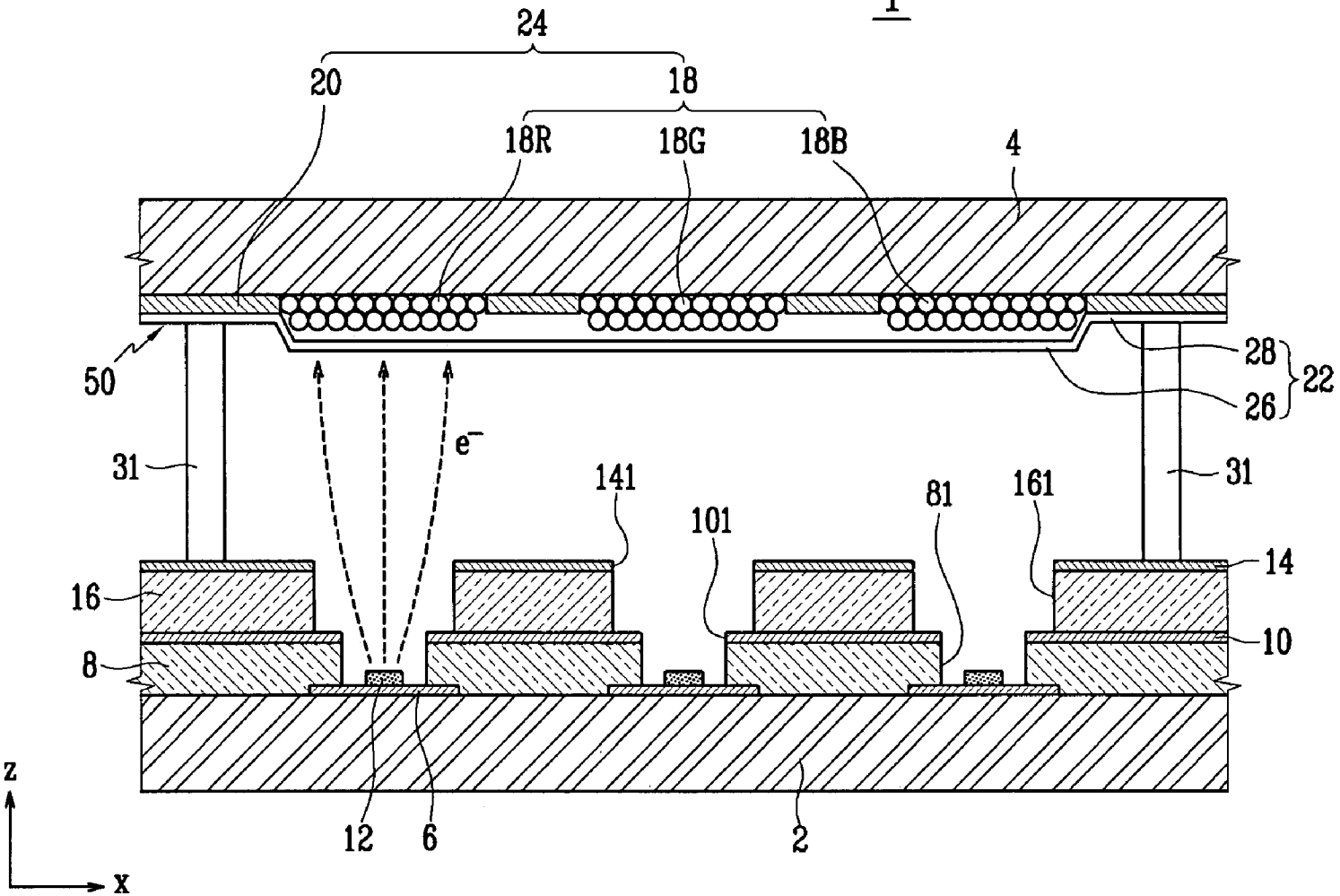
FIG. 2 is a partial sectional view of the electron emission display according to the first embodiment of the present invention.
Figure 3:
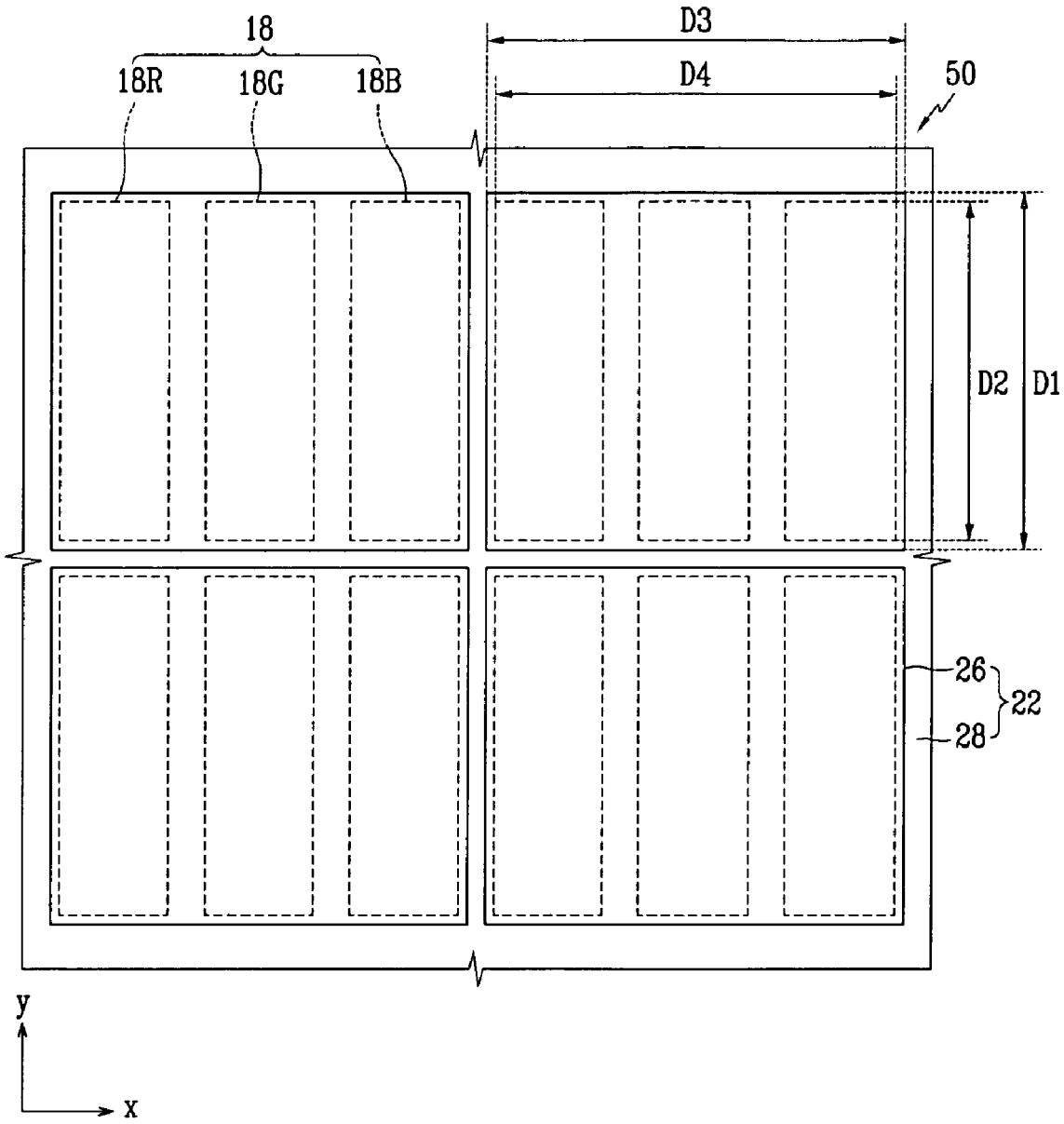
FIG. 3 is a partial bottom view of a light emission unit of the electron emission display according to the first embodiment of the present invention.

FIGS. 1 and 2 are a partial exploded perspective view and a partial sectional view of an electron emission display 1 according to a first embodiment of the present invention, and FIG. 3 is a partial bottom view of an electron emission unit (or device) 30 of the electron emission display 1 according to the first embodiment of the present invention.

As shown in FIGS. 1, 2, and 3, the electron emission display 1 includes first and second substrates 2 and 4 facing each other in parallel with a distance therebetween (wherein the distance therebetween may be predetermined). The first and second substrates 2 and 4 are sealed to each other at the peripheries thereof by way of a sealing member (not shown) to form a vessel, and the internal space of the vessel is evacuated to be at $10^{-6}$ Torr, thereby constructing a vacuum vessel (or chamber).

The electron emission unit (or device) 30 with electron emission regions 12 and driving electrodes 6 and 10 is provided on a surface of the first substrate 2 facing the second substrate 4, and a light emission unit 50 with phosphor layers 18 and an anode electrode 22 is formed on a surface of the second substrate 4 facing the first substrate 2.

Cathode electrodes 6 are stripe-patterned on the first substrate 2 along a first direction of the first substrate 2 (in a y axis direction of the drawings) as the first electrodes. A first insulating layer 8 is formed on the entire surface area of the first substrate 2 such that it covers the cathode electrodes 6. Gate electrodes 10 are stripe-patterned on the first insulating layer 8 along a second direction perpendicular to the cathode electrodes 6 (in an x axis direction of the drawings).

In this embodiment, sub-pixels are formed at the crossed regions of the cathode and gate electrodes 6 and 10, and one or more electron emission regions 12 are formed on the cathode electrodes 6 for each of the sub-pixels. Opening portions 81 and 101 are formed at the first insulating layer 8 and the gate electrodes 10 corresponding to the respective electron emission regions 12 to expose the electron emission regions 12 on the first substrate 2.

The electron emission regions 12 may be formed with a material for emitting electrons when an electric field is applied thereto under a vacuum atmosphere (or state), such as a carbonaceous material and a nanometer size material. For instance, the electron emission regions 12 may be formed with carbon nanotube (CNT), graphite, graphite nanofiber, diamond, diamond-like carbon (DLC), fullerene ($C_{60}$), silicon nanowire, or combinations thereof. The electron emission regions 12 may be formed through screen printing, direct growth, chemical vapor deposition, or sputtering.

It is illustrated in the drawings that one or more electron emission regions 12 are formed in the shape of a circle, and serially arranged along the longitudinal direction of the cathode electrodes 6 for each of the respective sub-pixels. However, the shape (e.g., the planar shape), the number per sub-pixel, and the arrangement of the electron emission regions 12 are not limited to those illustrated, and may be altered in various suitable manners.

A focusing electrode 14 may be formed on the gate electrodes 10 and the first insulating layer 8. A second insulating layer 16 is placed under the focusing electrode 14 to insulate the focusing electrode 14 from the gate electrodes 10. Opening portions 161 and 141 are also formed in the second insulating layer 16 and the focusing electrode 14 to allow the electron beams to pass. As shown in FIG. 1, the opening portions 141 and 161 are provided per the respective sub-pixels on a one to one basis such that the focusing electrode 14 collectively focuses the electrons emitted for each sub-pixel.

Phosphor layers 18, for instance, red, green, and blue phosphor layers 18R, 18G, and 18B are arranged on a surface of the second substrate 4 facing the first substrate 2 with a certain (or predetermined) distance therebetween, and black layers 20 are disposed between the respective phosphor layers 18 to enhance the screen contrast.

The phosphor layers 18 may be arranged on the second substrate 4 such that the one-colored phosphor layer 18R, 18G, or 18B corresponds to a respective sub-pixel of the first substrate 2. For instance, the red, green, and blue phosphor layers 18R, 18G, and 18B are repeatedly arranged along the long axis direction of the second substrate 4 (in the x axis direction of the drawings), and same-colored phosphor layers 18 are serially arranged along the short axis direction thereof (in the y axis direction of the drawings).

An anode electrode 22 is formed on the phosphor and black layers 18 and 20 with a metallic reflective material, such as aluminum. The anode electrode 22 receives a high voltage required for accelerating the electron beams from an external source, and reflects the visible rays radiated from the phosphor layers 18 to the first substrate 2 back toward the second substrate 4, thereby heightening the luminance.

The phosphor and black layers 18 and 20 are collectively called a phosphor screen 24. In this embodiment, the anode electrode 22 has spaced portions 26 spaced away from the phosphor screen 24 with a certain (or predetermined) gap, and contact portions 28 contacting the black layers 20 of the phosphor screen 24 between the spaced portions 26. The spaced portions 26 of the anode electrode 22 are spaced away from the phosphor screen 24 with the certain (or predetermined) gap due to the presence of a surface flattening layer formed during the manufacturing process of the electron emission display to be explained later.

The spaced portions 26 of the anode electrode 22 cover two or more of the phosphor layers 18 arranged along the long axis direction of the second substrate 4 (in the x axis direction of the drawings). For instance, it is illustrated in FIGS. 1 to 3 that the spaced portions 26 of the anode electrode 22 are arranged along the long axis direction of the second substrate 4 (in the x axis direction of the drawings), and cover the three red, green, and blue phosphor layers 18R, 18G, and 18B of a pixel.

With each spaced portion 26 of the anode electrode 22, as shown in FIG. 3, the width D1 thereof along the short axis direction of the second substrate 4 (in the y axis direction of the drawings) is established to be larger than the width D2 of the phosphor layer 18 along the same direction, and the width D3 thereof along the long axis direction of the second substrate 4 (in the x axis direction of the drawings) is established to be larger than the whole width D4 of the phosphor and black layers 18 and 20 placed along the same direction. That is, the area of each spaced portion 26 of the anode electrode 22 is established to be larger than the whole area of the phosphor and black layers 18 and 20 placed within the spaced portion 26. Such a width establishment of the spaced portions 26 of the anode electrode 22 is made to further enlarge the light reflection area of the spaced portions 26. The contact portions 28 of the anode electrode 22, disposed between the spaced portions 26 thereof, contact parts of the black layers (or certain ones of the black layers) 20 so that the anode electrode 22 is well adhered to the second substrate 4.

Spacers 31 are arranged between the first and second substrates 2 and 4 to endure the pressure applied to the vacuum vessel and to maintain the distance between the two substrates in a constant manner. The spacers 30 are located corresponding to the black layers 20 such that they do not intrude upon the area of the phosphor layers 18.

With the above-structured electron emission display 1, voltages (which may be predetermined) are externally applied to the cathode electrodes 6, the gate electrodes 10, the focusing electrode 14, and the anode electrode 22 to drive them. For instance, when the cathode electrode 6 receives a scanning driving voltage to function as a scanning electrode, the gate electrode 10 receives a data driving voltage to function as a data electrode (or vise versa). The focusing electrode 14 receives a voltage required for focusing the electron beams, for instance, 0V or a negative direct current voltage ranging from several to several tens of volts. The anode electrode 22 receives a voltage required for accelerating the electron beams, for instance, a positive direct current voltage ranging from several hundreds to several thousands of volts.

Then, electric fields are formed around the electron emission regions 12 at the sub-pixels where the voltage difference between the cathode and gate electrodes 6 and 10 exceeds the threshold value, and electrons are emitted from these electron emission regions 12. The emitted electrons pass through the focusing electrode opening portion 141, and are centrally focused into a bundle of electron beams. The electron beams are then attracted by the high voltage applied to the anode electrode 22 to thereby collide against (or with) the relevant phosphor layers 18 to excite the phosphor layers 18 so as to emit light.

With the electron emission display 1 according to the present embodiment, as the contact portions 28 of the anode electrode 22 contact the parts of the black layers 20, particularly the parts of the black layers 20 with the spacers 31 mounted thereon, damage(s) to the anode electrode 22 during the mounting of the spacers 31 is (are) reduced or prevented. Furthermore, as the spaced portions 26 of the anode electrode 22 proceed along the long axis direction of the second substrate 4 (in the x axis direction of the drawings) while covering two or more of the phosphor layers 18, the light reflection area of the anode electrode spaced portions 26 becomes widened, thereby heightening the screen luminance and reducing color mixing, as compared to the conventional anode electrode.

Figure 4:
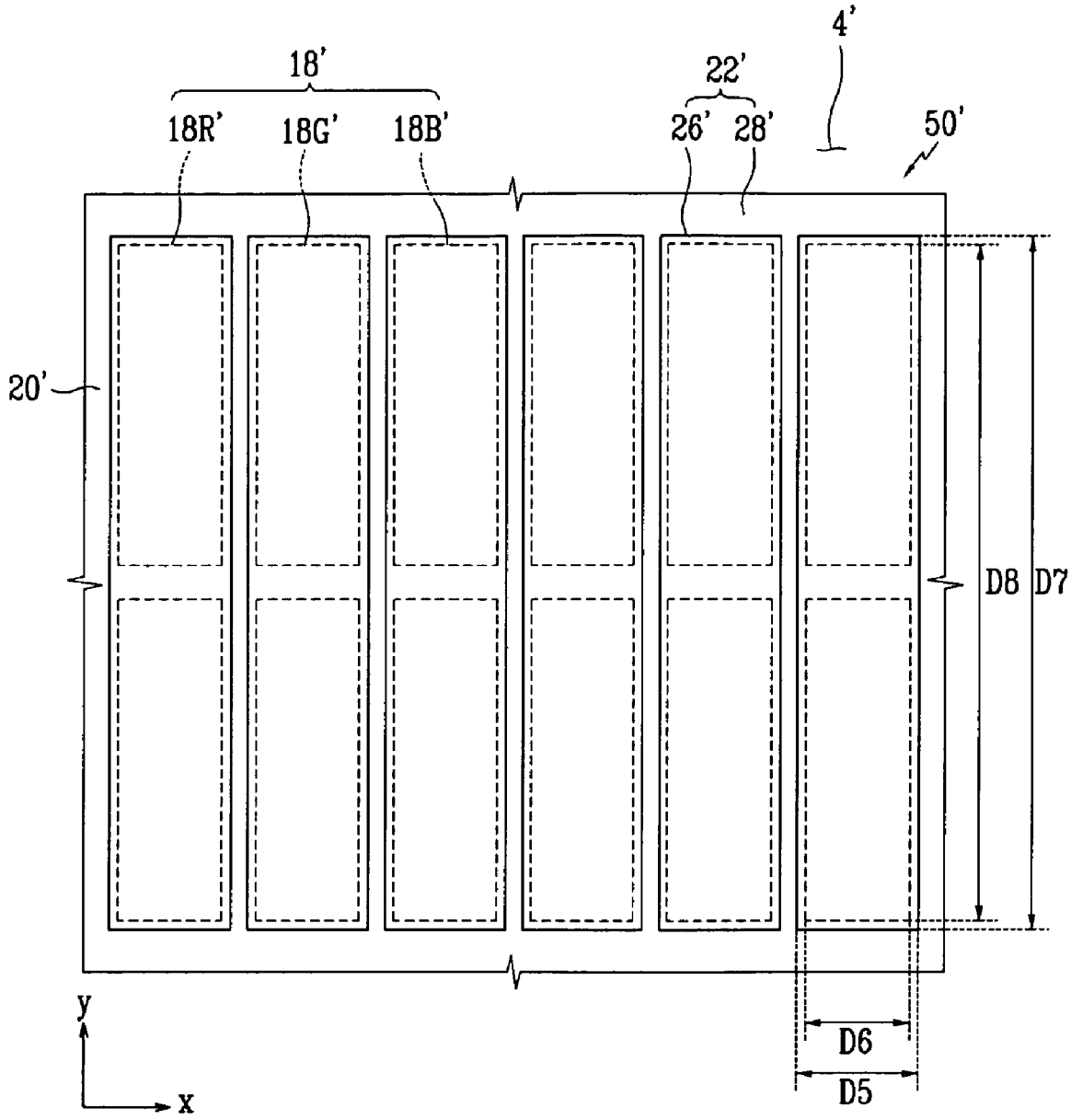
FIG. 4 is a partial bottom view of a light emission unit of an electron emission display according to a second embodiment of the present invention.

FIG. 4 is a partial bottom view of a light emission unit 50' of an electron emission display according to a second embodiment of the present invention.

As shown in FIG. 4, with the electron emission display according to the second embodiment of the present invention, each spaced portion 26' of an anode electrode 22' covers two or more phosphor layers 18' arranged along the short axis direction of a second substrate 4 (in the y axis direction of the drawings), and contact portions 28' thereof disposed between the spaced portions 26' contact parts of black layers 20'.

It is illustrated in FIG. 4 that the anode electrode spaced portions 26' cover two R phosphor layers 18R', two G phosphor layers 18G', or two B phosphor layers 18B' arranged along the short axis direction of the second substrate 4' (in the y axis direction of the drawings). In this case, the width D5 of each anode electrode spaced portion 26' along the long axis direction of the second substrate 4' (in the x axis direction of the drawings) is established to be larger than the width D6 of the respective phosphor layer 18R', 18G', 18B' in that direction, and the width D7 thereof along the short axis direction of the second substrate 4' (in the y axis direction of the drawings) is established to be larger than the whole width D8 of the phosphor and black layers 18' and 20' in that direction.

As same-colored phosphor layers 18' are placed along the short axis direction of the second substrate 4' (in the y axis direction of the drawings), color mixing is fundamentally reduced or prevented with the above-structured anode electrode 22', and the screen luminance is enhanced due to the enlargement in light reflection area of the anode electrode spaced portions 26'.

Also, in one embodiment of the present invention, the spaced portions of the anode electrode may cover both the two or more phosphor layers arranged along the long axis direction of the second substrate and the two or more phosphor layers arranged along the short axis direction of the second substrate.

Embodiments of the present invention have been explained above with respect to a display device using an FEA type of electron emission elements where the electron emission regions are based on a material for emitting electrons when an electric field is applied thereto under a vacuum atmosphere. However, the inventive structure is not limited to the FEA type of emission elements, and may be applied to other types of emission elements.

Figure 5:
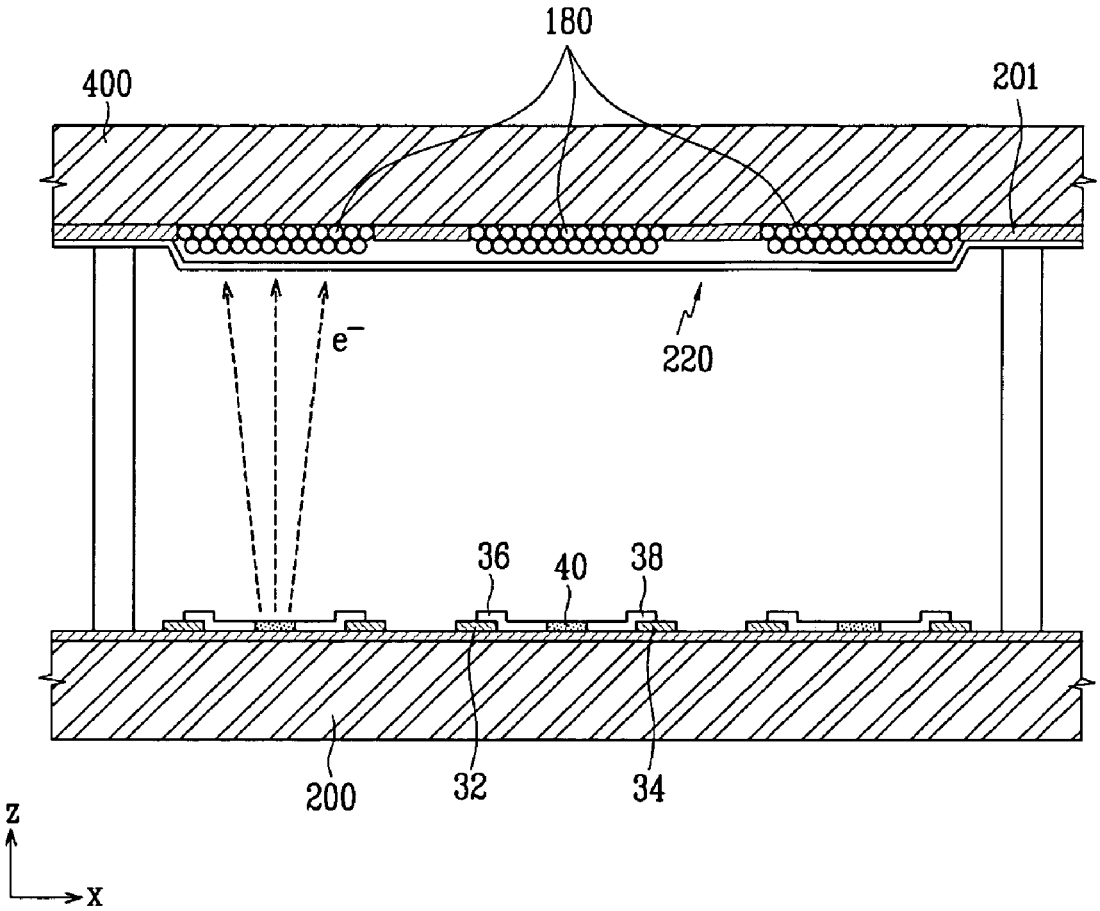
FIG. 5 is a partial sectional view of an electron emission display according to a third embodiment of the present invention.

FIG. 5 is a partial sectional view of an electron emission display according to a third embodiment of the present invention, using an SCE type of electron emission elements.

As shown in FIG. 5, first and second electrodes 32 and 34 are arranged on a first substrate 200 with a certain (or predetermined) distance therebetween, and first and second conductive thin films 36 and 38 are formed on the first and second electrodes 32 and 34 with a certain (or predetermined) distance so that the first and second thin films 36 and 38 are close to each other. Electron emission regions 40 are disposed between the first and second conductive thin films 36 and 38.

Various conductive materials may be used to form the first and second electrodes 32 and 34, and the first and second thin films 36 and 38 are formed with micro particles using a conductive material such as nickel (Ni), gold (Au), platinum (Pt), and/or palladium (Pd). The electron emission regions 40 provided between the first and second conductive thin films 36 and 38 may be formed with micro cracks, and/or with graphite-like carbon or a carbon compound.

With the above structure, when driving voltages are applied to the first and second electrodes 32 and 34, electric currents flow through the first and second conductive thin films 36 and 38 parallel to the surface of the electron emission regions 40 to thereby cause surface conduction type electron emission, and the emitted electrons are attracted by the high voltage applied to an anode electrode 220 toward a second substrate 400, followed by colliding against (or with) respective phosphor layers 180 to excite the phosphor layers 180 to emit light.

The structure of the phosphor layers 180, black layers 201, and the anode electrode 220 provided on the second substrate 400 is the same (or substantially the same) as that related to the first embodiment of the present invention, and hence, detailed explanation thereof will be omitted.

A method of manufacturing the electron emission display 1 according to the first embodiment of the present invention will be explained with reference to FIGS. 6A to 6D.

Figure 6A:
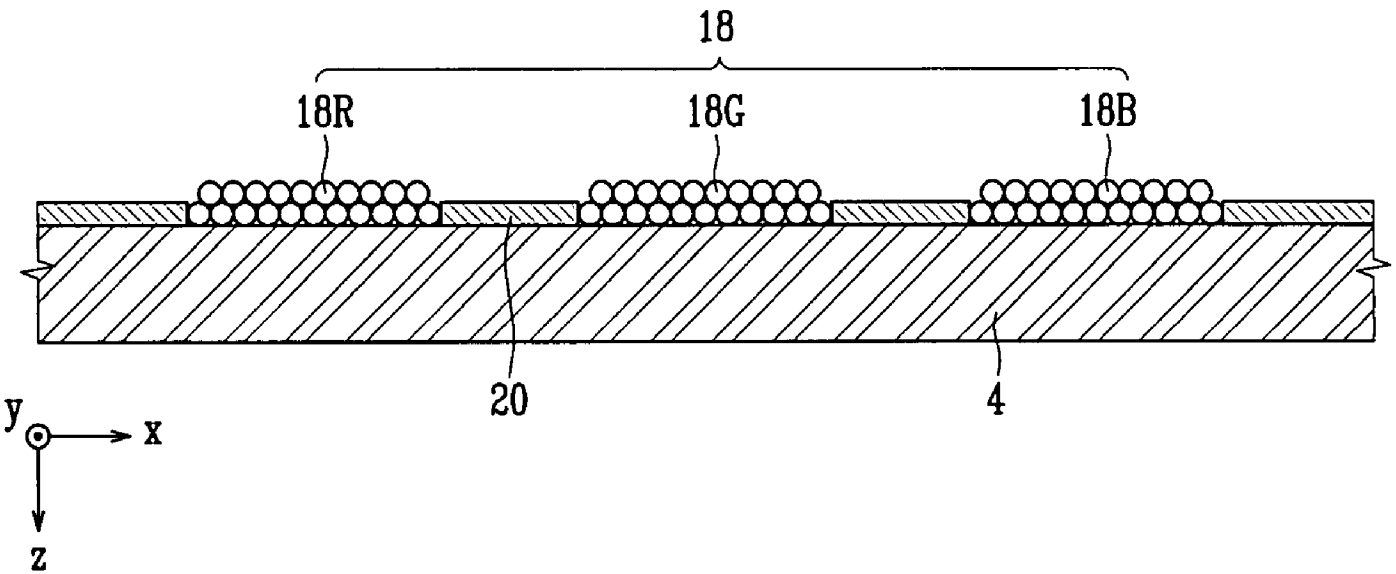
FIGS. 6A, 6B, 6C, and 6D schematically illustrate the steps of manufacturing a light emission unit of the electron emission display according to the first embodiment of the present invention.

First, as shown in FIG. 6A, the black layers 20 are formed on the second substrate 4 at the non-light emission areas. The black layers 20 may be formed by screen-printing a metallic material such as chromium and/or a carbon material such as graphite. Red, green, and blue phosphor layers 18R, 18G, and 18B are formed between the black layers 20 at the light emission areas.

Figure 6B:
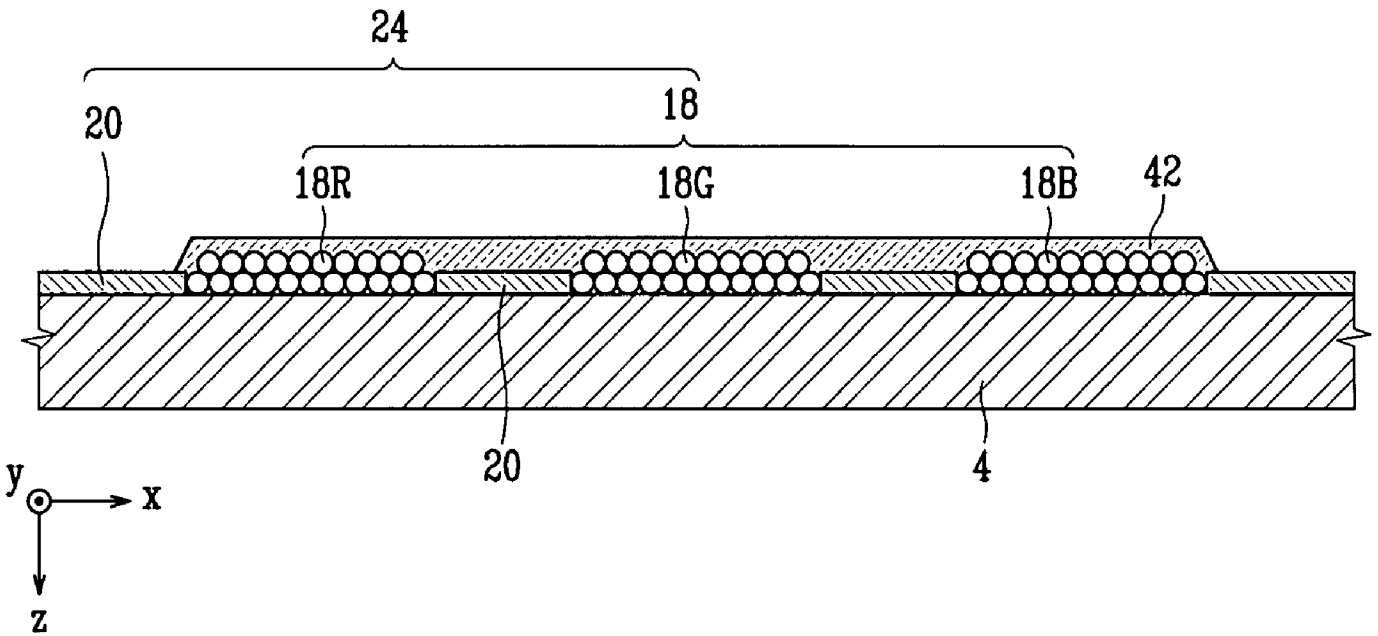

Thereafter, as shown in FIG. 6B, a surface flattening layer 42 is formed along the long axis direction of the second substrate 4 (in the x axis direction of the drawings) such that it covers two or more phosphor layers 18. It is illustrated in the drawings that the surface flattening layer 42 is formed on three phosphor layers 18 (e.g., three phosphor layers 18R, 18G, and 18B) and the black layers 20 between these phosphor layers 18. As described earlier, the width of the surface flattening layer 42 is established to be larger than the whole width of the three phosphor layers 18 and the black layers 20 disposed between those phosphor layers 18 along the long axis direction, thereby widening the light reflection area of the anode electrode spaced portions 26. The surface flattening layer 42 is formed with a high molecular material decomposed at a firing temperature of about 430° C.

Figure 6C:
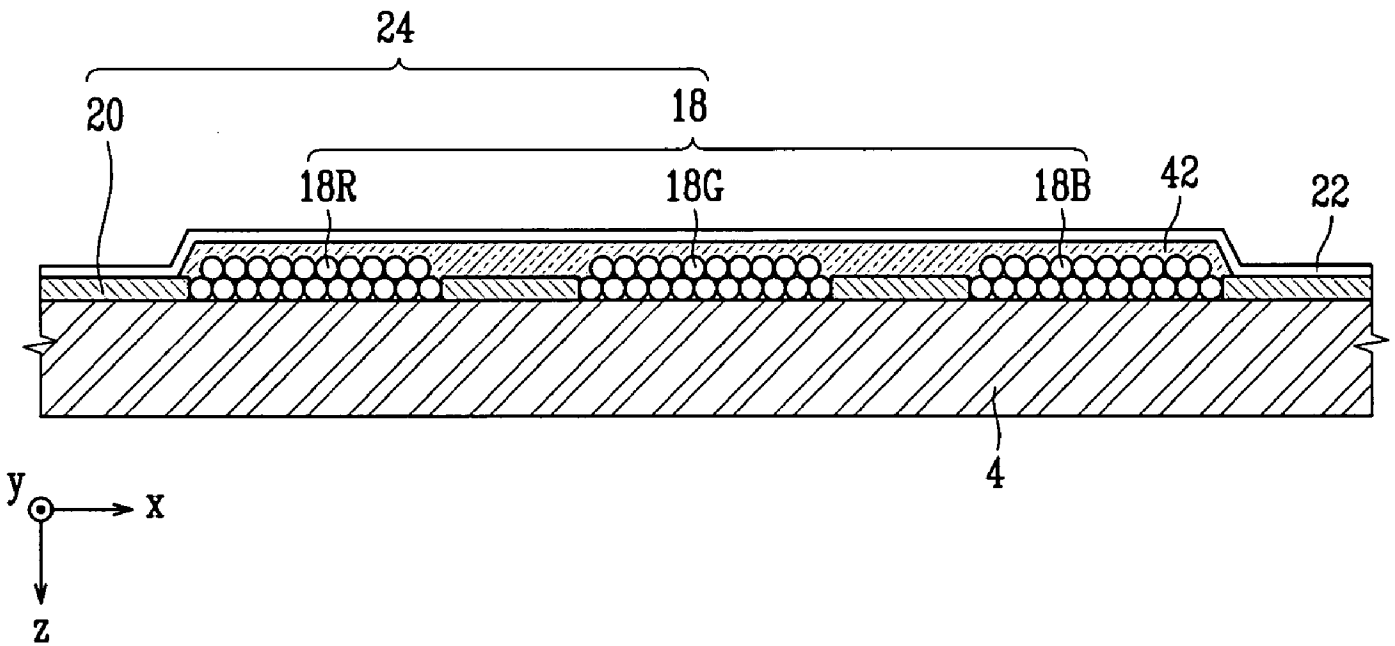

As shown in FIG. 6C, a metallic material like aluminum is vapor-deposited or sputtered on the entire surface of the second substrate 4 with the surface flattening layer 42 to thereby form the anode electrode 22. The anode electrode 22 is formed on the surface flattening layer 42, and the black layers 20 with (or having) no surface flattening layer 42.

Figure 6D:
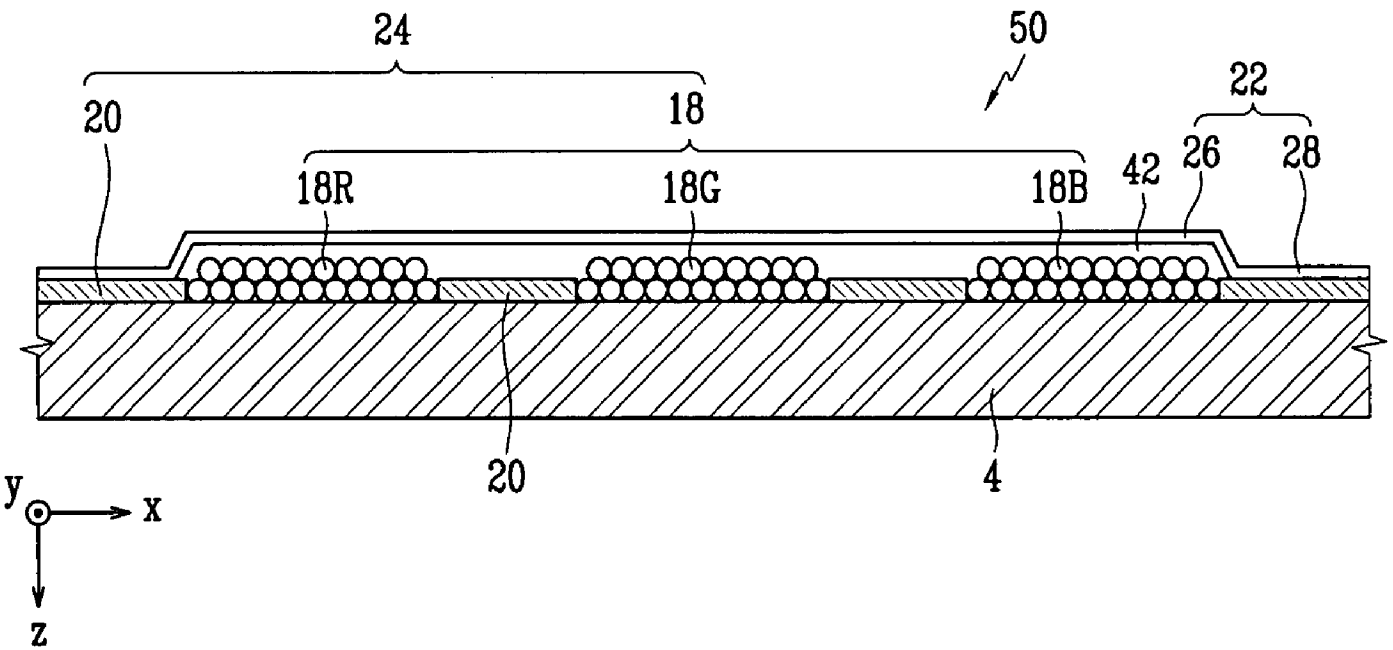

Thereafter, the second substrate 4 is fired to remove the surface flattening layer 42, thereby completing the light emission unit 50 as shown in FIG. 6D. The anode electrode 22 has the spaced portions 26 covering three phosphor layers 18R, 18G, and 18B arranged along the long axis direction of the second substrate 4 (in the x axis direction of the drawings). The remaining portions of the anode electrode 22, except for the spaced portions 26, become the contact portions 28 directly contacting the black layers 20.

Finally, the electron emission regions 12 and the driving electrodes for controlling the electron emission regions 12 are formed on the first substrate 2, and the first and second substrates 2 and 4 are sealed to each other at their peripheries to thereby form a vacuum vessel. The interior of the vacuum vessel is exhausted through an exhaust tube (not shown), thereby completing the electron emission display 1.

The formation of the surface flattening layer 42 may alternatively cover two or more phosphor layers 18 placed along the short axis direction of the second substrate 4. In this case, a light emission unit 50' of the electron emission display according to the second embodiment of the present invention may be completed. Furthermore, the surface flattening layer 42 may be formed to cover both the two or more phosphor layers 18 placed along the long axis direction of the second substrate, and the two or more phosphor layers 18 placed along the short axis direction thereof.

As described above, with an electron emission display according to an embodiment of the present invention, an anode electrode includes a plurality of spaced portions and a plurality of contact portions. The spaced portions of the anode electrode are formed to cover two or more phosphor layers placed along the long axis direction of a second substrate and/or along the short axis direction thereof so that the light reflection area of the anode electrode spaced portions is enlarged to thereby heighten the screen luminance, and the color mixing is reduced to thereby enhance the display quality. Furthermore, with the electron emission display according to the embodiment of the present invention, the contact portions of the anode electrode contact parts of a plurality of black layers, and hence, damage(s) to the anode electrode during the mounting of spacers is (are) reduced or prevented.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display comprising:

a first substrate;

a second substrate facing the first substrate;

a plurality of first electrodes on the first substrate along a first direction;

a first insulating layer on the first substrate such that the first insulating layer covers the first electrodes;

a plurality of second electrodes on the first insulating layer along a second direction such that the second electrodes cross the first electrodes, sub-pixels being formed at crossed regions of the first and second electrodes;

a plurality of electron emission regions on the first electrodes and within the sub-pixels;

a plurality of phosphor layers on a surface of the second substrate corresponding to the sub-pixels such that the phosphor layers are spaced apart from each other with a distance therebetween; and a metallic reflection layer on the second substrate such that the metallic reflection layer covers the phosphor layers, wherein the metallic reflection layer comprises a plurality of spaced portions, each of the spaced portions covering at least two of the phosphor layers respectively placed corresponding to the sub-pixels, wherein the plurality of spaced portions are spaced away from the phosphor layers with an open gap between the spaced portions and the phosphor layers, and wherein the metallic reflection layer further comprises a plurality of contact portions connecting the spaced portions and not spaced away from the second substrate with an open gap therebetween.

2. The electron emission display of claim 1, wherein the spaced portions of the metallic reflection layer cover two or more of the phosphor layers arranged along a long axis direction of the second substrate.

3. The electron emission display of claim 1, wherein the spaced portions of the metallic reflection layer cover two or more of the phosphor layers arranged along a short axis direction of the second substrate.

4. The electron emission display of claim 1, wherein the spaced portions of the metallic reflection layer are formed to simultaneously cover two or more of the phosphor layers arranged along a long axis direction of the second substrate and two or more of the phosphor layers arranged along a short axis direction of the second substrate.

5. The electron emission display of claim 1, wherein an area parallel to a surface of the second substrate of each of the spaced portions of the metallic reflection layer is established to be larger than a whole area parallel to the surface of the second substrate of the at least two of the phosphor layers placed within each of the spaced portions.

6. The electron emission display of claim 1, further comprising a plurality of black layers disposed between the phosphor layers and partially contacting the contact portions of the metallic reflection layer.

7. The electron emission display of claim 6, further comprising a plurality of spacers arranged between the first and second substrates corresponding to contact portions of the metallic reflection layer.

8. The electron emission display of claim 7, wherein the metallic reflection layer is an anode electrode.

9. The electron emission display of claim 1, wherein the metallic reflection layer is an anode electrode.

10. An electron emission display comprising:

a first substrate;

a second substrate facing the first substrate;

a first electrode on the first substrate along a first direction;

a first insulating layer on the first substrate such that the first insulating layer covers the first electrode;

a second electrode on the first insulating layer along a second direction such that the second electrode crosses the first electrode;

an electron emission region on the first electrode;

a plurality of phosphor layers on a surface of the second substrate such that the phosphor layers are spaced apart from each other with a distance therebetween; and an anode electrode on the second substrate such that the anode electrode covers the phosphor layers, wherein the anode electrode comprises a plurality of spaced portions, each of the spaced portions covering at least two of the phosphor layers, wherein the plurality of spaced portions are spaced away from the phosphor layers with an open gap between the spaced portions and the phosphor layers, and wherein the anode electrode further comprises a plurality of contact portions connecting the spaced portions and not spaced away from the second substrate with an open gap therebetween.

11. The electron emission display of claim 10, further comprising a plurality of black layers disposed between the phosphor layers and partially contacting the contact portions of the anode electrode.

12. The electron emission display of claim 11, further comprising a plurality of spacers arranged between the first and second substrates corresponding to contact portions of the anode electrode.

13. The electron emission display of claim 10, wherein the spaced portions of the anode electrode cover two or more of the phosphor layers arranged along a long axis direction of the second substrate or two or more of the phosphor layers arranged along a short axis direction of the second substrate, or wherein the spaced portions of the anode electrode cover two or more of the phosphor layers arranged along a long axis direction of the second substrate and two or more of the phosphor layers arranged along a short axis direction of the second substrate.

* * * * *